United States Patent [19]

Focke et al.

[11] 4,225,040

[45] Sep. 30, 1980

[54] PACKAGE FOR CIGARETTES OR THE LIKE AND PROCESS FOR PRODUCTION OF SAME

[75] Inventors: Heinz Focke; Kurt Liedtke, both of Verden, Fed. Rep. of Germany

[73] Assignee: Focke & Pfuhl, Verden, Fed. Rep. of Germany

[21] Appl. No.: 886,700

[22] Filed: Mar. 15, 1978

[30] Foreign Application Priority Data

Mar. 22, 1977 [DE] Fed. Rep. of Germany ..... 2712482

[51] Int. Cl.[3] ..... 229 87C; B65D 85/10

[52] U.S. Cl. ..... 206/245; 206/265; 206/273; 220/418; 220/450

[58] Field of Search ..... 206/273, 245, 265, 269; 229/87 C; 220/418, 450

[56] References Cited

U.S. PATENT DOCUMENTS

| | | | |
|---|---|---|---|
| 452,109 | 5/1891 | Maloney | 229/87 C |
| 695,273 | 3/1902 | Birnie et al. | 220/418 |
| 1,969,384 | 8/1934 | Perine | 229/87 C X |
| 2,005,351 | 6/1935 | Rosenblatt | 229/87 C X |
| 2,047,625 | 7/1936 | Geerlings | 229/87 C |
| 2,244,282 | 6/1941 | Bergstein | 229/3.1 X |
| 2,305,371 | 12/1942 | Yates | 220/418 |
| 2,316,919 | 4/1943 | Waters | 220/418 |
| 2,710,134 | 6/1955 | Schroeder et al. | 220/418 X |
| 3,265,287 | 8/1966 | Houland | 206/273 X |
| 3,273,780 | 9/1966 | Chalmers | 229/87 C X |
| 3,333,683 | 8/1967 | Scharre | 229/87 C X |
| 3,948,389 | 4/1976 | Molins et al. | 229/87 C X |

*Primary Examiner*—Stephen P. Garbe

*Attorney, Agent, or Firm*—Sughrue, Rothwell, Mion, Zinn and Macpeak

[57] ABSTRACT

A package and a process for making the same is disclosed. The package is especially useful for cigarettes and is of the hard cup type being made with a packing body of cardboard, pasteboard or similar material. The body of the package is provided on the outside with a moisture and odor (aroma) tight coating and, at least at the upper edge, a strip of inside tin foil wrapping is attached for the formation of a front fold. The arrangement simplifies the package blank and results in a finished package having an over-all metal coating.

6 Claims, 13 Drawing Figures

II 11a
11a
31
31
25
25
23
I
17
19
16
18
20
30
16
27
28
24
32
32
30
21
26
26
22
11b
11b
II

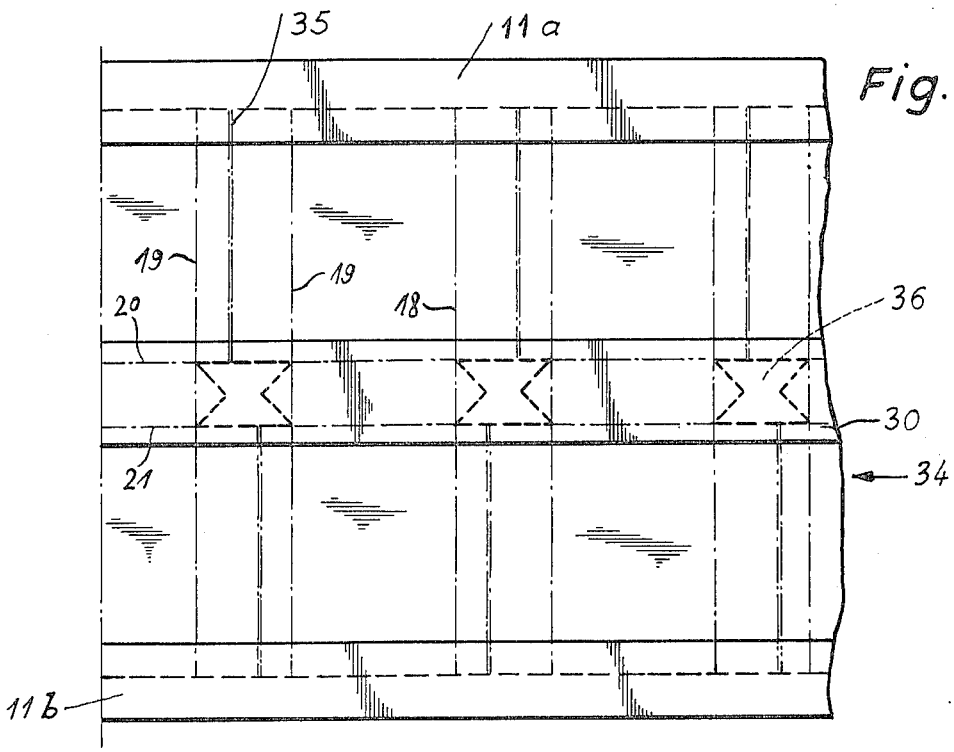
Fig. 5
Fig. 6
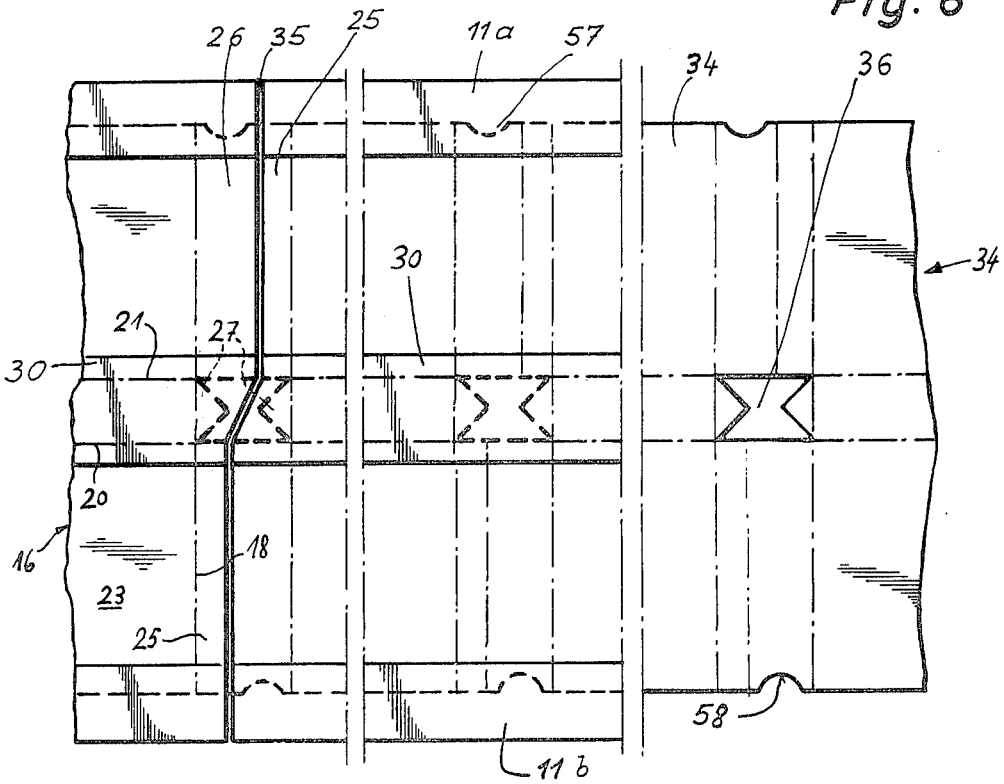

PACKAGE FOR CIGARETTES OR THE LIKE AND PROCESS FOR PRODUCTION OF SAME

FIELD OF THE INVENTION

The invention relates to a package for cigarettes or the like and especially a hard cup package with a packing body of cardboard, pasteboard, etc., and a thin foil inside wrapper for the cigarettes. Furthermore, the invention relates to a process for the production of such packages.

SUMMARY OF THE INVENTION

The invention deals with a certain type of package which is particularly suitable for the reception of cigarettes. The actual box body consists of a cup open on top made of relatively stiff working material, namely cardboard, pasteboard, etc. Usually the bottom is formed from bottom flaps off the package body. On the upper side, an inside wrapper for the cigarettes made of a tin foil blank projects partly from the cup. The package thus consisting of two blanks, namely the tin foil blank and the hard cup blank is customarily provided with an outside wrapping of cellophane, etc.

The object of the invention is to develop and further improve the type of package mentioned. Especially, it is a matter of making the package simpler in its structure and of getting along with less packaging material without impairing the quality, and yet increasing its air-tight characteristics.

The package of the invention is characterized for the solution of this object by the fact that the outside of the package body is provided with a moisture (steam) resistant and or aroma proof (gas proof) coating, especially a metal coating, and that at least at the upper edge a strip of the inside fold (tin foil strip) is attached for the formation of the front-side fold.

The tin foil strip is attached to the front edge of the body of the package on the inside, for example by gluing. According to a further proposal of the invention, the tin foil strip is attached to the packaging material of the body of the package, especially prior to production of the blanks. Thus undivided (two or more-piece) blanks are formed, from which a finished package is made directly. This package requires neither an otherwise customary inside wrapping of tin foil, completely wrapping up the cigarettes, nor an outside wrapping of cellophane, etc. Accordingly, the form of the package and especially of the blank, is based on the realization, that the outside of the package must be largely resistant to moisture. This requirement is primarily necessary because of the storage of such packages in areas susceptible to moisture, for example, in automatic cigarette vending machines. The metal coating provided according to the invention has the added advantage that it contributes considerably to preserving the aroma and preventing a premature drying out of the tobacco. The appearance of the package moreover resembles that of a customary hard cup package.

Additional characteristics of the invention relate to details of construction of the package and to a process for its production, or for the production of the blanks for the package.

BRIEF DESCRIPTION OF THE DRAWINGS

Embodiments of the invention are explained subsequently in more detail with reference to the drawings, in which:

FIG. 5 shows a section of a web of packaging material for the production of blanks as in FIG. 1;

FIG. 6 shows the individual phases of production for the web as in FIG. 5;

DESCRIPTION OF THE PREFERRED EMBODIMENTS

Figure 3:
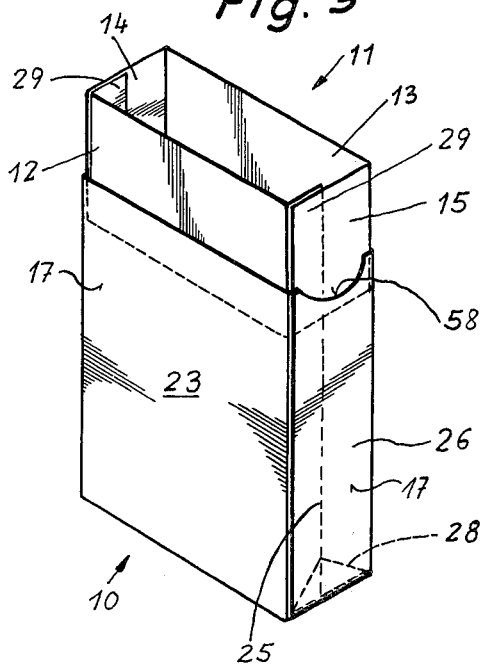
FIG. 3 shows a package open on top, namely on the front side of a blank of FIGS. 1 and 2 in perspective presentation.
Figure 4:
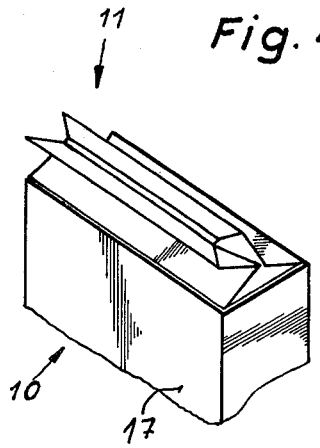
FIG. 4 shows the upper part of the package of FIG. 3 with partial folding in the area of the front side.

The invention relates to a certain type of a square-shaped package, namely a so-called hard cup package, as shown for example, in FIG. 3, in its open state. A cup shaped packing body 10, open on top consists of a relatively rigid material, especially cardboard, paste board, etc. According to FIG. 3, a front side closing piece in the shape of an encircling strip 11 of tin foil is inserted into the body of this package. The strip enters with a lower marginal area into the body of the package 10 and is attached to its inside, for example, by gluing. The part of the tin foil strip 11 projecting from the body of the package 10 forms longitudinal terminal flaps 12 and 13, always opposite each other and lateral terminal flaps 14 and 15 as well. The latter are folded into the upper front surface in order to close the package. The fold may be made in any arbitrary way, for example, in the sense of FIG. 4 as a so-called "fin-folding" of a known design.

The body of the package 10 is provided on the outside with a moisture and/or odor proof coating especially with a metal foil or layer, which is laminated on or applied in some other way. Since the tin foil strip 11 is likewise attached with metal coating turned outside, the package has a complete outside metal coating. In this package the content of the package, especially a group of cigarettes, is accommodated directly and without a separate inside blank. Also, there is no need for an outside wrapper of cellophane.

Figures 1, 2:
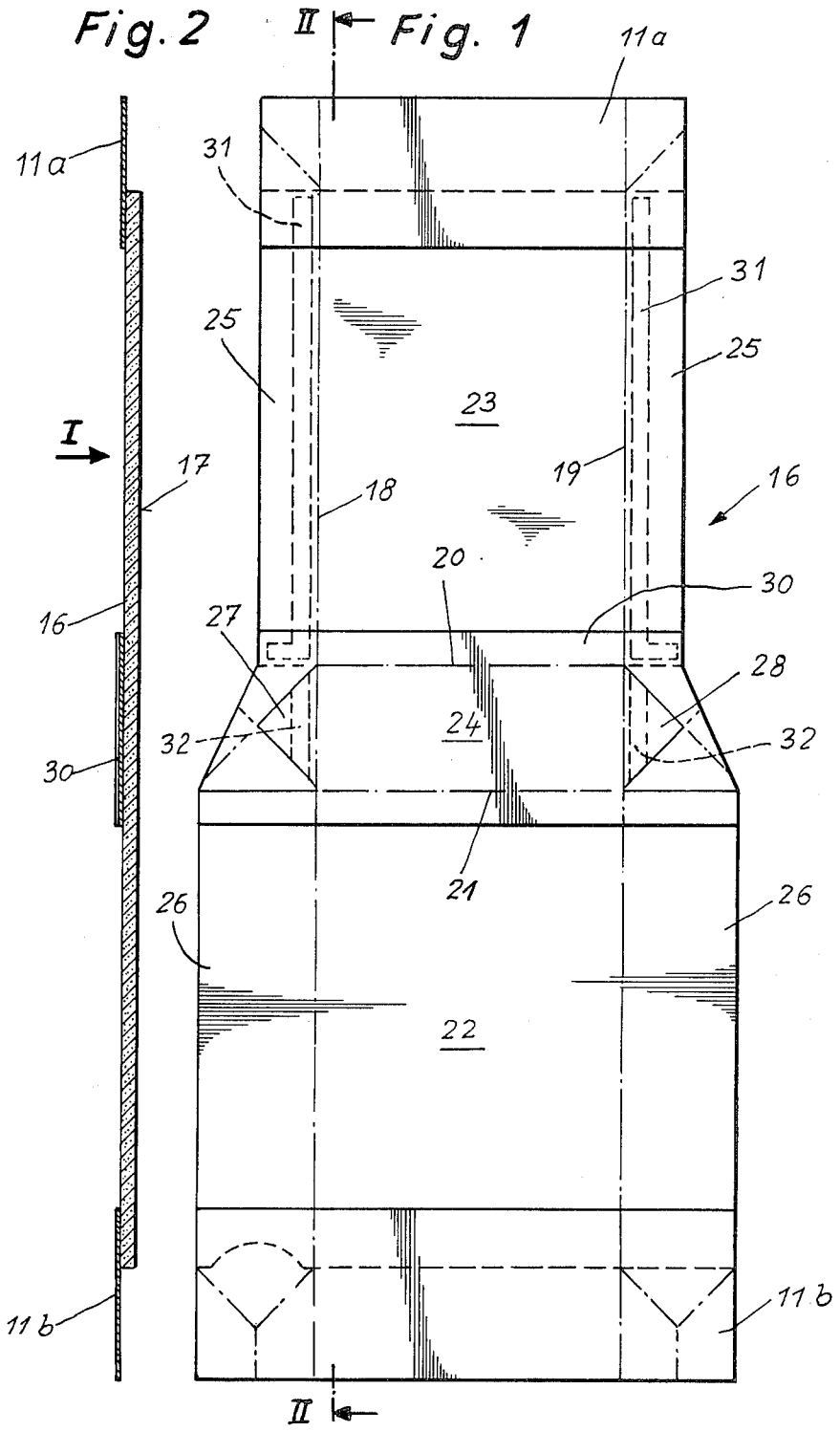
FIG. 1 shows a spread out blank for a package according to a first embodiment.
FIG. 2 shows a longitudinal cut through the blank of FIG. 1.

The package according to FIG. 3 consists of a blank, which is spread out in FIG. 1, and shown in longitudinal section in FIG. 2. The blank consists of a base blank 16 of paste board, cardboard, etc., with a metal coating 17 (FIG. 2). The base blank 16 is subdivided into fields (sections) by pre-stamped longitudinal folding lines 18 and 19 as well as by transverse folding lines 20 and 21, for the formation of a front wall 22, a rear wall 23 and a bottom wall 24. Lateral flaps 25 and 26 follow on the front wall 22 and the rear wall 23 for the formation of lateral walls of the package.

The base blank 16 is folded in the shape of a U around the contents of the package. Then the lateral walls are formed by partial covering of the lateral flaps 25 and 26. The first mentioned lateral flaps 25 are developed with a lesser width and lie on the inside, while the outside lateral flaps 26 completely cover up the surface of the side wall of the package. In the present case, triangular wedges 27 and 28 belonging to the base blank 16, are formed in the area of the bottom wall 24, which in the completed package fit against the inside of the side wall.

Tin foil strips 11*a* and 11*b* are disposed at the free terminal areas of the base blank 16, for the formation of the front-side closure, and to be sure, in this case always in the width of the base blank 16 in this marginal area. The tin foil strips 11*a* and 11*b* are attached (glued) on the inside of the base blank 16. In case of the not-closed, but otherwise completely folded package (FIG. 3), a coverup 29 in the area of the side walls results through the dimensioning of the tin foil strips 11*a*, 11*b*.

In order to ensure a tight packing also in the area of the bottom wall 24 and of the adjoining parts of the blanks, an additional support in the shape of a sealing strip 30 has been provided here. This sealing strip 30, continuous over the width of the base blank 16, which for example, may consist of tin foil, is laminated on to the base blank 16, and to be sure in such a way that the sealing strip 30 extends into the area of the adjacent front and rear wall 22 or 23 as well as of the side flaps 25 or 26.

The strips applied to the base blank 16, namely tin foil strips 11*a*, 11*b* as well as sealing strips 30, are effectively provided with pre-stamped folding lines, which result in a certain folding pattern. The sealing strip 30, in the area of the triangular wedges 27 and 28, forms a "sealing skin" in the width of the bottom wall 24, which, in case of the completely folded package is folded inbetween the triangular wedge 27 or 28, and the lateral flaps 25 or 26.

The base blank 16 is provided in the area of the narrower side flaps 25 and of the triangular wedges 27 and 28 with an applied strip of sizing 31 or 32. These strips of sizing, especially hotmelt, are applied here on the side with metal coating, and as a result are not covered up by the subsequently applied strips.

Figure 7:
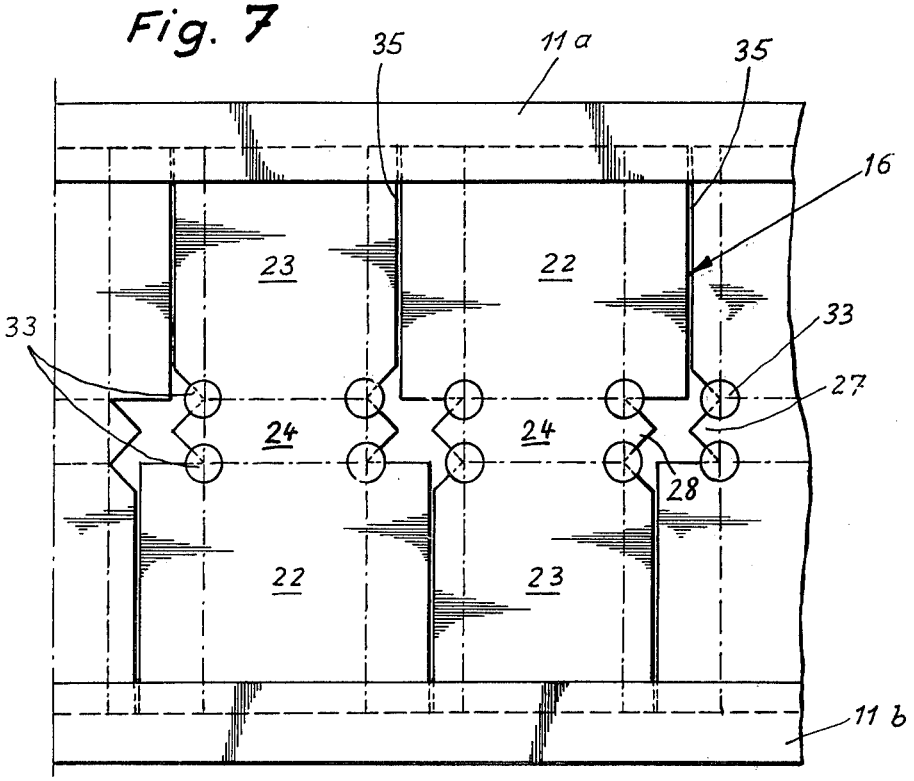
FIG. 7 shows a section of a web of packaging material corresponding to FIG. 5 for another embodiment of the package.
Figure 8:
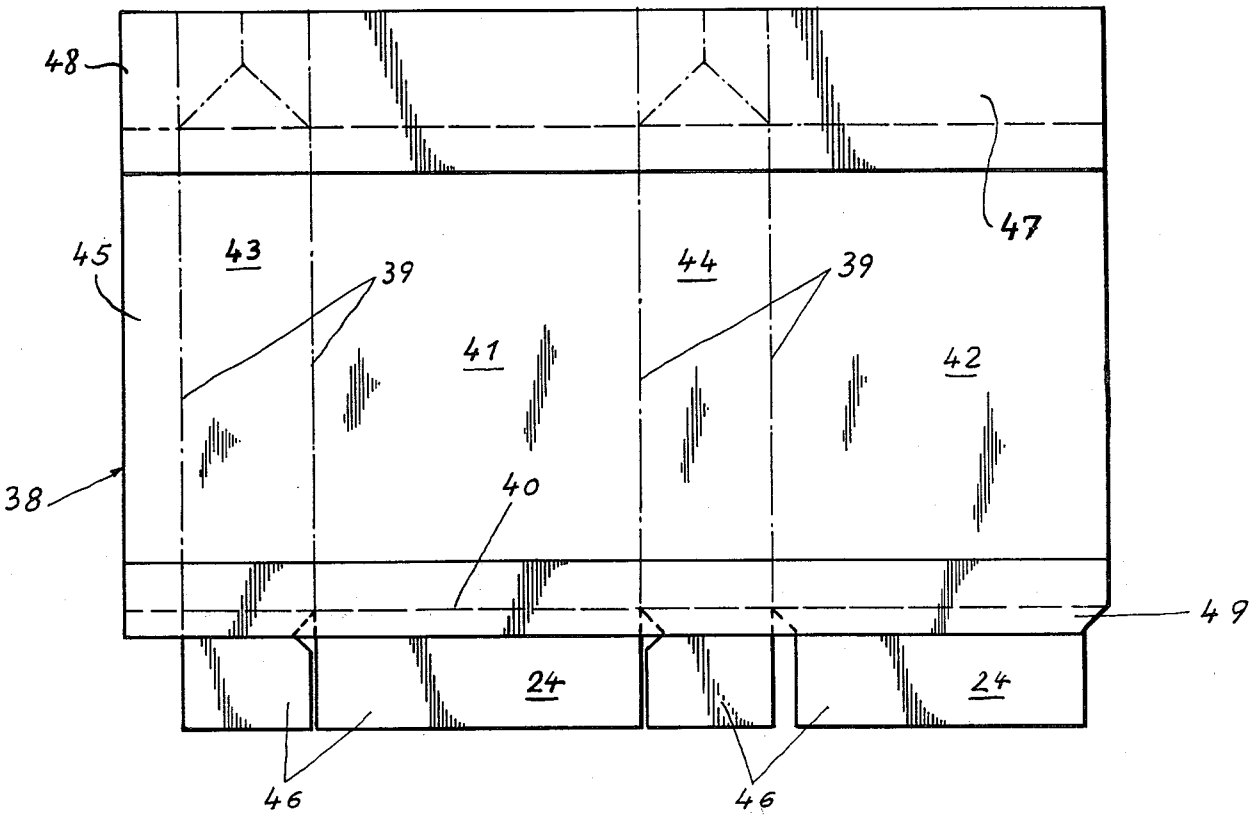
FIG. 8 shows a spread out blank for a third embodiment of the package.

With regard to the development of the package in the area of the bottom wall 24, FIG. 7 shows an alternative. Instead of the continuous sealing strips 30, in this case individual sealing flaps 33 are provided, which are glued onto the base blank 16 in the area of the four corners of the package on the side of the bottom wall 24. The previously mentioned sealing flaps 33 are likewise folded during making of the package. The sealing flaps 33 consist of a suitable aroma proof material, for example, in the form of a metal coating.

FIGS. 5 and 7 disclose proposals for an optimum production of blanks for making packages of the previously described kind. The blanks are cut from a continuous web. The latter consists of a middle strip 34 of cardboard, etc., in any case for forming the base blanks. This middle strip 34 is provided with the needed longitudinal folding lines 18, 19 and transverse folding lines 20, 21. Furthermore, an x-shaped recess 36 is stamped out in the area of a subsequent separating cut 35 between subsequent blanks. Then continuous tin foil strips 11*a* and 11*b* are applied at the outside edges of the middle strip 34. In case of the embodiment of FIGS. 5 and 6 the continuous sealing strip 30 is applied at the same time in the middle of the middle strip 34. The finished, continuous web (FIG. 5 or FIG. 6 middle and FIG. 7) is then subdivided into individual blanks by separating cuts 35. The separating cut 35 incorporates at the same time also the strips of tin foil 11*a*, 11*b*, as well as the likewise present sealing strip 30. In the area of the latter, the separating cut 35 runs slantingly in case of the present embodiment. Otherwise the blanks are always displaced by 180° in the web or are separated from it, so that narrow and wide lateral flaps 14, 15 always succeed each other.

FIGS. 8 to 11 show details of a package, where the body of the package 37 is placed in the form of a tube around the content of the package. Correspondingly the base blank 38 is divided by longitudinal folding lines 39 and a transverse folding line 40 into sections for the forming of the front wall 41, the rear wall 42 and the side walls 43 and 44. A marginal strip 45 follows the side wall 43 which in case of the tubular wrapping of the package contents is connected with the inside of the rear wall 42.

In case of the present embodiment, bottom flaps 46 follow the front wall 41, rear wall 42 and side walls 43, 44 which are folded back in order to form a bottom wall.

The edge of the base blank 38, being opposite the bottom flap 46, is provided here too with a continuous tin foil strip 47, which is applied on the inside of the base blank 38, provided with a metal coating on the outside. The tin foil strip 47 going all around with an overlap 48, serves, as has already been described, for the production of a frontal closure, for example by "fin folding" (FIG. 10).

In order to seal the package in the area of the bottom wall 24, the base blank 38 has been provided with a cross sealing strip 49 which extends both in a partial area of the front, rear and side walls as well as of the bottom flap 46. This results in a package with "sealed corners".

Figure 11:
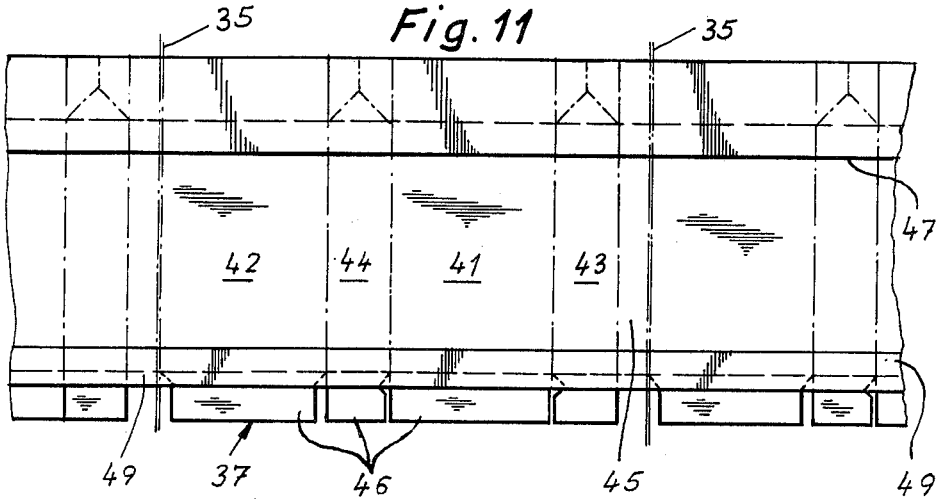
FIG. 11 shows the section of a web of packaging material for the production of blanks as in FIG. 8.

In case of the present embodiment too, the blanks are made from a continuous web of packing material (FIG. 11). Here however, the individual blanks succeed each other directly. Prior to separation, strips 47 of tin foil and sealing strip 49 are applied as continuous strips at the places of the inside of the web, provided for this purpose.

Figure 10:
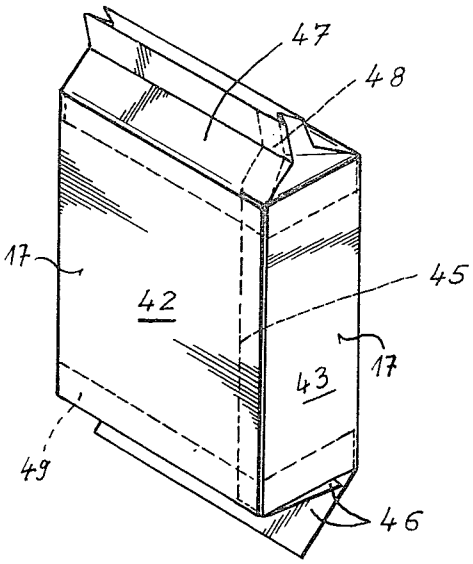
FIG. 10 shows the almost completed package of FIG. 9 likewise in perspective presentation.
Figure 9:
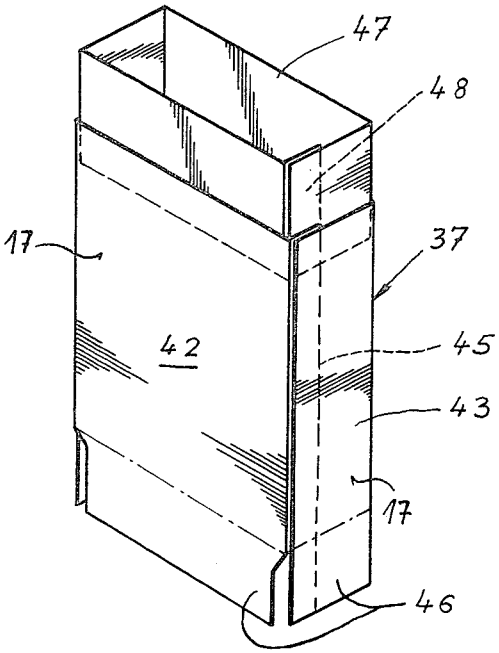
FIG. 9 shows an intermediate folding position of a package from a blank as in FIG. 8 in perspective presentation.
Figure 12:
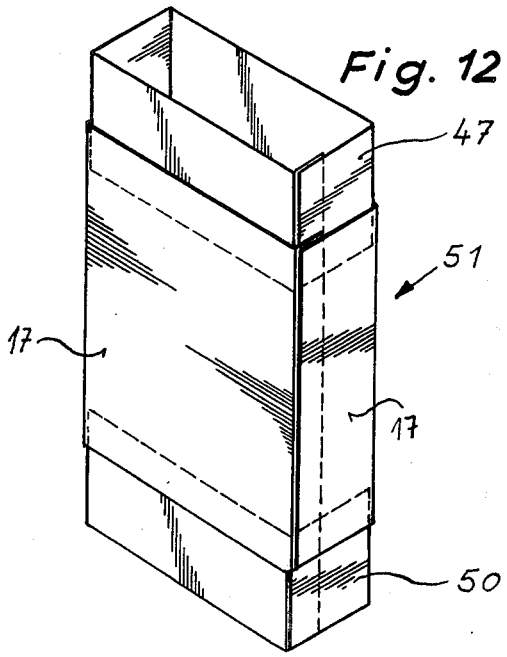
FIG. 12 shows a fourth embodiment of a package in perspective presentation in an intermediate folding position.

FIG. 12, as compared to the embodiments of FIGS. 9 and 10, shows a modification insofar as in this case too the bottom is formed by a tin foil strip 50. A base blank 16 extends therefore in this case merely in the area of the surface of the package.

Figure 13:
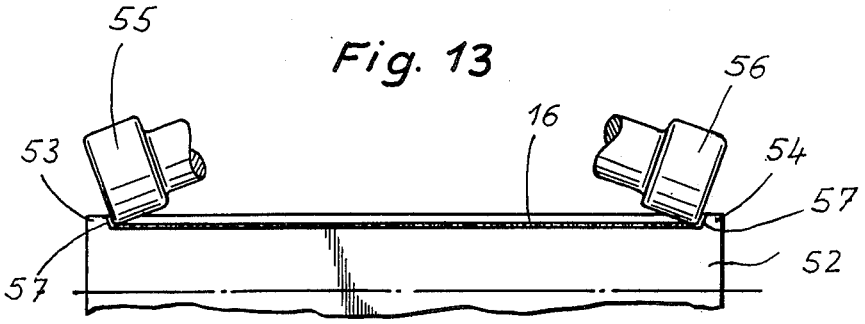
FIG. 13 shows the detail of an apparatus in connection with a packaging machine for pre-treatment of the blanks for the packages in schematic presentation.

In FIG. 13, when the thickness of the wall of the material for the base blank has been taken into consideration, the free edges of the base blank, especially in the area of overlapping blank-parts, are formed with sharpened edges. For this purpose the pertinent edges are shaped by use of pressure ending in sharp edges. The apparatus suitable for this is shown schematically in FIG. 13. The pertinent blank 16 lies on a support 52 with lateral marginal elevations 53, 54. The blank 16 extends at the same time to the marginal elevations 53, 54. Pressure rolls 55, 56 lie on top of blank 16 in the area of these edges. The pressure rolls 55, 56 are moved rotatably over the blank 16 under considerable pressure with the axes in an oblique direction. At the same time, the likewise obliquely directed inside surfaces 57 of the marginal elevations 53, 54 form a supporting (stop) and guide surface for the pressure rolls 55 or 56, so that the latter merely rest with essentially their outside edge on the edge of the blank 16 and as a result compress the latter while forming a sharpened edge. As a result of the edge, ending in a sharp edge, the seal of the package is increased above all in the area of such connecting places, because here the penetration of moisture is decreased or impossible.

In order to facilitate the opening of the packages developed as described, an arch-shaped recess 58 is provided in the area of at least one of the side walls of the package body at the upper edge. Here, the free-lying tin foil may be grasped and torn open.

What is claimed is:

1. A package for cigarettes or the like of the hard cup type, characterized by:

(a) a generally rectangular hard cup package body formed from a blank of relatively thick, stiff paper, cardboard or similar material and having a moisture and aroma-proof metal coating covering its entire outer surface, (b) an upwardly open mouth of the package body having a relatively thin and pliable strip of metal foil attached by gluing or the like to its inside edges to form openable closing folds of the package, (c) a floor member of the package body being formed from elements of the relatively thick and stiff blank, and (d) the package body having relatively thin and pliable sealing layers of metal foil in its interior at least in the areas of the four corners of the floor member.

2. A package according to claim 1, wherein the package body is formed by successive back, floor and front walls folded in the shape of a U around the package contents, and a strip of metal foil is attached to the upper inside edge of both the front and back walls and includes adjoining lateral side flaps for mutual folding engagement to form side walls of a closure package.

3. A package according to claims 1 or 2, wherein the package body is provided in the floor area with a sealing strip which extends over the entire width of the blank.

4. A package as claimed in claim 1, wherein said sealing layers of metal foil comprise separate sealing portions (33) of an aroma-proof, easily foldable material glued to the inside of each of said four corners.

5. A package as claimed in claim 1, wherein said package body (37) of said base blank (38) is folded in the shape of a tube around the contents of the package, and said openable closing folds are provided by a continuous and encircling tin foil strip (47).

6. A package as claimed in claim 5, wherein said floor member of said package body (37) is formed from folded-back bottom flaps (46) of said base blank (38) and said pliable sealing layers of metal foil comprise a continuous sealing strip (49) attached on the inside of said package body (37) in the area of said floor member corners.

* * * * *